United States Patent [19]

Hayashi

[11] 4,396,365

[45] Aug. 2, 1983

[54] ROTARY VANE TYPE COMPRESSOR

[75] Inventor: Kazuo Hayashi, Yokohama, Japan

[73] Assignee: Nissan Motor Co., Ltd., Yokohama, Japan

[21] Appl. No.: 213,117

[22] Filed: Dec. 4, 1980

[30] Foreign Application Priority Data

Dec. 11, 1979 [JP] Japan ..... 54-160463[U]

[51] Int. Cl.[3] ..... F04F 5/46; F04B 21/00; B23P 15/00

[52] U.S. Cl. ..... 418/179; 418/235; 418/236; 29/156.4 R

[58] Field of Search ..... 418/236, 235, 238, 179; 29/156.4 R, 156.8 R, 156.8 B

[56] References Cited

U.S. PATENT DOCUMENTS

| | | | |
|---|---|---|---|
| 19,004 | 12/1857 | Young | 418/236 |
| 3,730,655 | 5/1973 | Lamm | 418/235 |
| 4,253,809 | 3/1981 | Ishizuka | 418/179 |

FOREIGN PATENT DOCUMENTS

| | | | |
|---|---|---|---|
| 769092 | 10/1980 | U.S.S.R. | 418/236 |

*Primary Examiner*—Ronald B. Cox

[57] ABSTRACT

A rotary vane type compressor having a rotor (8) mounted with a number of vanes (10) each accommodated in a vane groove (11) of a liner (12) made of anti-abrasive material and a boss (13) for fixing the liners (12) and the liners are fixed in position with respect to the boss by integrally casting the liners and the boss by placing them in the predetermined position using light weight alloy.

5 Claims, 5 Drawing Figures

ROTARY VANE TYPE COMPRESSOR

BACKGROUND OF THE INVENTION

The present invention relates to a rotary vane type compressor, or more particularly, to such a compressor suitably used in a vehicle mounted air conditioner.

A conventional rotary vane type compressor used for a vehicle air conditioner or cooler generally comprises a rotor rotated by a driving shaft and having vane grooves, in which vanes are mounted slidably, and the rotor is housed in a chamber formed by a cam housing and end plates. In such a conventional rotary vane type compressor used for a vehicle mounted air cooler, the vanes are made of light weight alloy materials in order to decrease the centrifugal force applied thereon and the other parts are made of iron or iron based materials for obtaining anti-abrasion characteristics. More specifically, the rotor is generally made of steel or steel base materials so that the overall weight is large, and there is a disadvantage in that the assembling should be done with considerably high accuracy since the clearances of the sliding surfaces between the vanes and the vane grooves and between the rotor and the cam housing will not change from the beginning period of operation to the normal operation period, due to thermal expansion.

SUMMARY OF THE INVENTION

The present invention is to improve the aforementioned inconvenience of the conventional rotary vane type compressors.

According to the present invention, the object is attained by forming the rotor of the compressor from liners each having a vane groove and a boss for fixing the liners made individually of anti-abrasive material, and the liners and the boss are cast together of light weight alloy to form an integral part after placing them in a desired position.

DESCRIPTION OF THE PREFERRED EMBODIMENT

Figure 1:
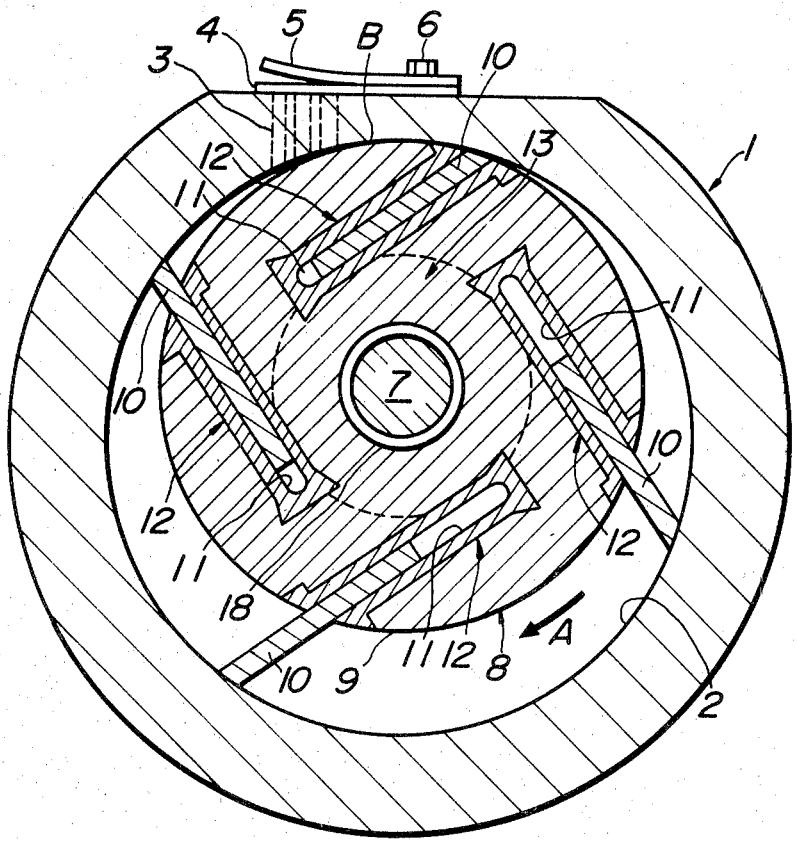
FIG. 1 is a vertical cross-sectional view across the axis of the rotary vane type compressor according to the present invention.

The invention will now be explained by referring to a particular embodiment illustrated in the accompanying drawings.

Referring to the figures, reference numeral 1 designates a cam housing, which has a cam surface 2 at the inner side. The cam housing 1 is provided with end plates (not shown) at both ends. At an ejecting port 3 of the cam housing 1, an ejecting valve 4 is mounted with an ejecting valve support 5 by a fixing screw 6. A rotor 8 fixedly coupled with a driving axis 7 is inserted in the cam housing 1. Compression chambers are confined by an outer surface 9 of the rotor 8, vanes 10 mounted slidably on the rotor 8, and said end plates. The rotor 8 comprises a plurality of liners 12 having vane grooves

Figure 4:
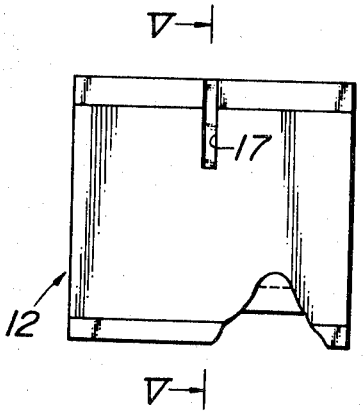
FIG. 4 is a plan view of the liner.
Figure 5:
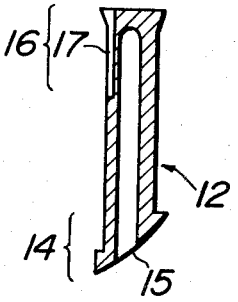
FIG. 5 is a cross-sectional view taken along line V—V in FIG. 4.

11 and made of anti-abrasive material (for instance steel) and a boss 13 for fixing the liners in position, and the liners and the boss are unitarily formed by casting of a light weight material, for instance aluminium alloy. The boss 13 has fixing means for placing the liners 12 in the respective predetermined position. More details of the liners 12 are shown in FIGS. 4 and 5. The front portion 14 thereof has a circular surface 15 forming a part of the outer surface 9 of the rotor except an opening being a portion of the vane groove 11. The rear end portion 16 of the liner 12 is dovetail shaped with a groove 17 for coupling with the boss 13.

Figure 3:
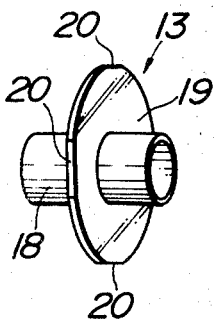
FIG. 3 is a perspective view of the boss on a decreased scale.

The boss 13 has a cylindrical portion 18 for coupling with the rotary driving axis 7 and a flange portion 19 formed integrally with the cylindrical portion 18. At the outer periphery of the flange portion 19, a number of mounting surfaces 20 providing engagement with the groove 17 of the liners 12 are formed. (Refer to FIG. 3.)

Figure 2:
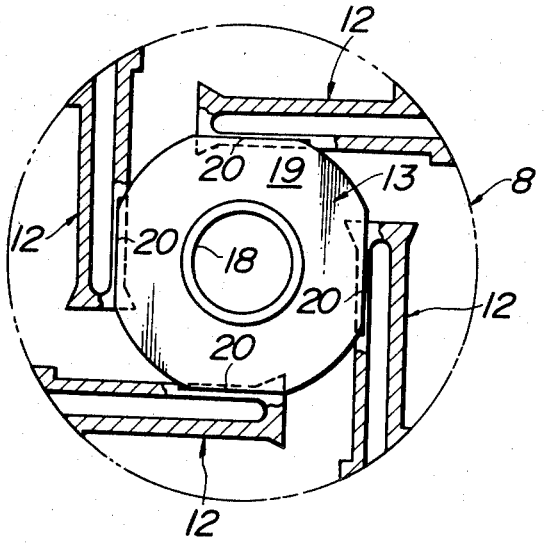
FIG. 2 is an explanatory view showing the coupling condition of the liners and the boss.

The liners 12 are assembled with the boss 13 by placing them in the position as indicated in FIG. 2 by fitting the groove 17 onto the mounting surface 20 of the flange portion 19 and the liners 12 and the boss 13 are jointly moulded or cast of a light weight alloy to form the rotor 8 as an integral unit. At the time of this joint casting, the rotor 8 is formed by casting the light weight alloy filling up to the portion indicated by the imaginary line in FIG. 2 except for the vane groove 11 and the central hollow portion of the cylindrical portion 18 and letting it solidify.

The operation of the compressor made according to the present invention will be explained hereinafter. When the rotor 8 is driven to rotate by the rotary driving axis 7 in the direction of arrow A shown in FIG. 1, the vanes 10 mounted thereon move to protruded or projected positions as shown in the drawing, by the centrifugal force and abut against the cam surface 2 of the cam housing 1. Each volume of the compression chambers confined by the vanes 10 is gradually decreased according to the rotation in the compression stage from the suction side. According to the invention, at the beginning period of operation, the gap between the vane 10 and the vane groove 11 is made wider and the clearance in the contact portion (B) between the cam surface 2 and the rotor 8 is also made wider. The basic design of the compressor according to the present invention is such that in the normal operation period said gap between the vane 10 and the vane groove 11, and said contact clearance between the cam surface and the rotor, are arranged to assume suitable and nearly optimum amounts for compression to match the light weight alloy material of the rotor 8 by the thermal expansion of the light weight alloy portion of the rotor 8 due to a temperature rise of the cooling gas media by compression and that caused by frictional resistance between the sliding parts. By the variation of the aforementioned clearances in normal operation, the vane 10 is accommodated in the vane groove 11 formed in the liner 12 made of anti-abrasive material with more small clearances suitable for compression. At the beginning period of starting, when the rotor is cold, the vane 10 is housed in the vane groove 11 with a wider clearance to allow easy sliding to decrease initial torque. Furthermore, the rotor 8 maintains a most suitable contact with the cam surface 2 for compression in normal operation to obtain a high efficiency.

As has been explained in the foregoing according to the present invention, the constructional parts of the compressor to be considered for wear, i.e. the vane groove and the boss being the junction of the rotating axis, are individually and separately formed from anti-abrasive materials, and the rotor is integrally cast after fixing the liners at predetermined position on the boss by a light weight alloy casting. The rotary vane type compressor of the present invention having the rotor of the aforementioned construction can be made substantially light weight compared with the conventional one, and it has further advantages in that an optimum clearance between the vane and the vane groove can be obtained at normal operation by the difference of the thermal expansion coefficient and that a suitable contact clearance can be obtained between the rotor and the cam surface for the same reason so that volume efficiency for compression is very large due to close sealing contact in the contact portions in operation while the starting resistance is very small.

Although the invention has been explained by taking one particular embodiment only, a number of alternatives may be considered without departing from the scope of the invention as claimed in the appended claims.

What is claimed is:

1. A rotary vane type compressor comprising: a rotor having an essentially disc-like boss, a plurality of individual liners respectively formed of an anti-abrasive material and with a vane groove, said liners being arranged on said boss in circumferentially spaced relationship, said liners and said boss having irregular shape providing a rigid engagement therebetween and providing a fixed predetermined position for said liners on said boss, and a casting of lightweight alloy material interconnecting said liners and said boss.

2. A rotary vane type compressor as claimed in claim 1, wherein the anti-abrasive material is steel.

3. A rotary vane type compressor as claimed in claim 1, wherein the anti-abrasive material is steel based alloy.

4. A rotary vane type compressor as claimed in claim 1, wherein the light weight alloy is aluminium alloy.

5. A rotary vane type compressor as claimed in claim 1, wherein the liner is formed with an engaging groove with the boss and the boss is formed with a cylindrical portion to be coupled with a rotating axis of the compressor and a flange portion integrally formed therewith and the flange portion is provided with mounting surfaces to be fit with the liners with the engaging groove to secure the predetermined position.

* * * * *